US005738556A

United States Patent [19]

Palmieri

[11] Patent Number: 5,738,556

[45] Date of Patent: Apr. 14, 1998

[54] LEASH FOR AN AQUATIC SPORTS BOARD

[76] Inventor: Gregory G. Palmieri, 1332 E. Ticonderoga Dr., Fresno, Calif. 93270

[21] Appl. No.: 698,179

[22] Filed: Aug. 15, 1996

Related U.S. Application Data

[60] Provisional application No. 60/002,521, Aug. 18, 1995.

[51] Int. Cl.[6] ..... A63C 15/00

[52] U.S. Cl. ..... 441/75

[58] Field of Search ..... 441/65, 74, 75, 441/79; 119/770, 775, 795, 798; 267/182, 136, 142, 153, 69

[56] References Cited

U.S. PATENT DOCUMENTS 4,234,990 11/1980 Colburn ..... 441/75
4,285,083 8/1981 Wilson ..... 441/75

*Primary Examiner*—Stephen Avila
*Attorney, Agent, or Firm*—Dickinson, Wright, Moon, Van Dusen & Freeman

[57] ABSTRACT

A leash is described for attachment between an aquatic sports board and a rider. The leash includes a molded single piece elastic article having an elongated elastic member terminated at its ends with eyelets. A strap connector capable of being attached to the rider is connected through an eyelet on one end of the member. A board coupler is provided at the other end for attaching the leash to the board.

9 Claims, 3 Drawing Sheets

LEASH FOR AN AQUATIC SPORTS BOARD

CROSS-REFERENCE TO RELATED APPLICATIONS

This application claims the benefit of U.S. Provisional Application No. 60/002,521, filed Aug. 18, 1995.

FIELD OF THE INVENTION

This invention relates to a leash for an aquatic sports board and a method for making the same. More particularly, this invention relates to an elastic leash wherein the cord and eyelets are formed as a one piece molded article.

BACKGROUND OF THE INVENTION

Aquatic sports boards, for instance, bodyboards and surfboards typically have a leash that allows the rider to maintain possession of the board. Such leashes comprise an elastic portion which is intended to progressively absorb some of the jolting force experienced when the board and rider separate to the point where all the slack in the leash has been taken up. The leashes available on the market today comprise an extruded length of elastic rod or tube which is cut to length and then modified to provide eyelets on the ends. After the formation of the elastic member, eyelets are formed by doubling over the end portion to create a loop. Once the loop is formed, it is secured either by a metal clip or a tie-cord with shrink wrap plastic heat-formed around it. Alternatively, a preformed eyelet component may be glued to the end of the elastic member. These formed or affixed eyelets are then used as a means to attach a wrist or ankle connector to one end of the elastic member while attaching the opposite end, of the elastic member, to a stud in the board.

It is known in the prior art to provide molded rigid, flexible, elastic or non-elastic articles such as straps, bands and bungee cords having holes, openings or other attachment means. However, such articles are typically not suitable for use as leashes for aquatic sports boards.

The problem with leashes heretofore is that they require multiple steps to form the elastic member and associated eyelets on each end. As noted above, the conventional leashes used an involved process to form and secure loops on each end. These processes are inadequate because the metal clasp and shrink wrap plastic can have sharp edges which exposes the rider to injury. In addition, these methods of attaching the eyelets and securing the formed loops are susceptible to the harsh environmental conditions and are prone to premature failure. Therefore, there is a need for an aquatic sports board leash having eyelets attached to the elastic member so that the integrity of the elastic portion is not compromised and the rider is not unduly exposed to injury.

Therefore, it is an object of the present invention to provide a leash for an aquatic sports board comprising an elongated elastic rod having an eyelet on each end formed as a single molded plastic article.

It is another object of this invention to provide a system for connecting an aquatic sports board with a rider comprising an elastic member terminated with eyelets on each end formed as a single molded article, a wrist or ankle connector strap attached through one eyelet, and on the opposite end an attachment means for connecting the elastic member to the sports board.

It is yet another object of this invention to provide a method of making a leash for an aquatic sports board including the steps of molding an elongated elastic article having eyelets on each end, attaching a wrist or ankle connector strap to one eyelet, and attaching to the eyelet on the opposite end a sports board coupling member.

It is a further object of this invention to provide an aquatic sports board leash, comprising an elongated elastic member with an eyelet on each end, formed from a single polymeric elastic material as a one piece molded article.

It is still a further object of this invention to provide an aquatic sports board leash having an elongated elastic element, having eyelets on each end, formed as a one piece molded article wherein the cross-sectional area of the eyelets is larger than the cross-sectional area of the cord.

These and other objects of the present invention will become readily apparent after studying and understanding the present invention, as hereinafter described.

SUMMARY OF THE INVENTION

The present invention is a leash for an aquatic sports board comprising a one piece molded elongated elastic member with a head on each end having an opening extending therethrough. Together, the head and the opening form an eyelet for attaching a wrist or ankle connector strap to one end and a coupler, for attaching the leash to a board, on the opposite end.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
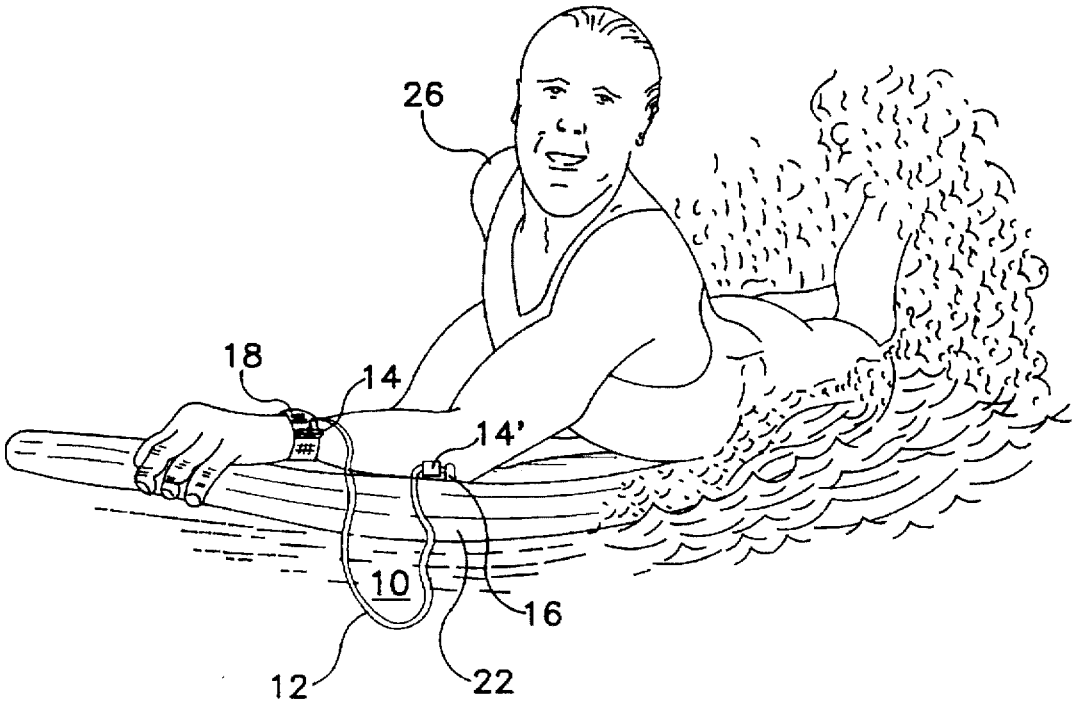
FIG. 1 is a perspective view of a leash attached to a bodyboard and a rider.

Before the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 2:
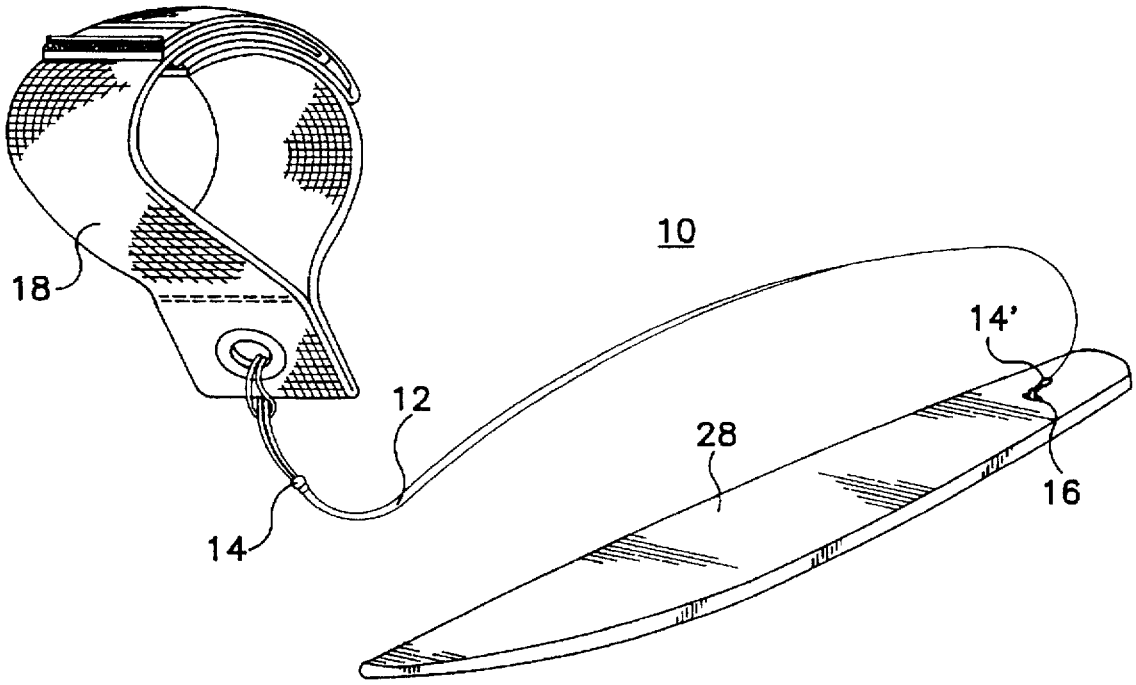
FIG. 2 is a perspective view of a leash with a wrist strap attached to a surfboard.

FIGS. 1 and 2 illustrate one embodiment being representative for illustrative purposes only. FIG. 1 shows a leash 10 of the present invention attached to a bodyboard 22 and a rider 26. The leash comprises a molded elastic rod 12 terminated on each end by a head 14 & 14', a wrist or ankle strap 18 and a board coupler The bodyboard 22 has a stud extending from the surface of the board for receiving a portion of the board coupler 16. The board coupler 16 couples a head 14' on one end of the molded rod 12 to the board 22. The opposite end of the leash 10 the wrist strap 18 is attached to the second head 14 of the molded rod 12. The two heads of the leash 14 & 14' are molded portions on each end of a single piece molded elastic rod 12. As shown in FIG. 2, the leash 10 can be attached to a surfboard 28 in a similar fashion.

Figure 3:
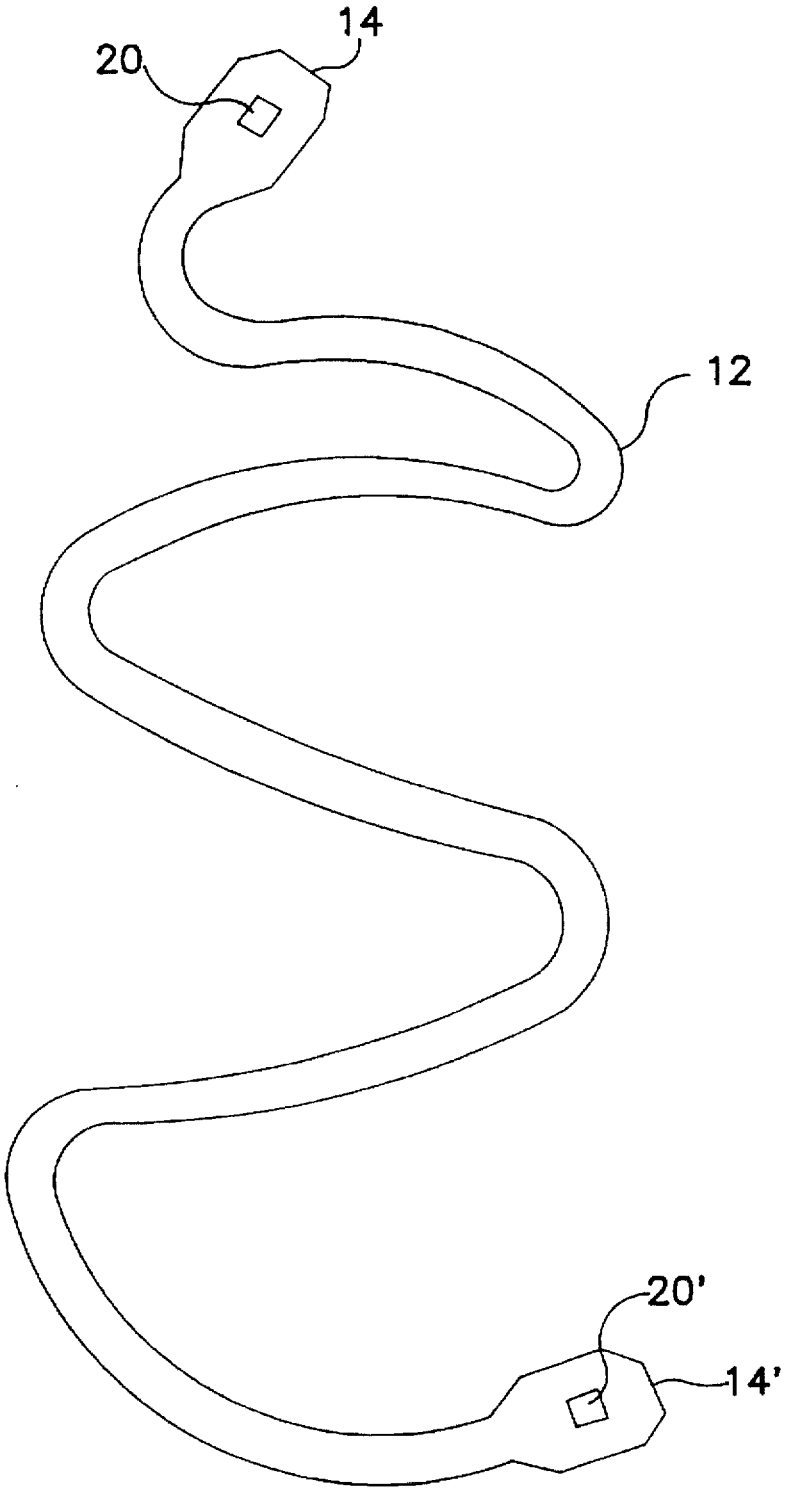
FIG. 3 is a plan view of the molded elastic portion of the leash shown in FIGS. 1&2.
Figure 4:
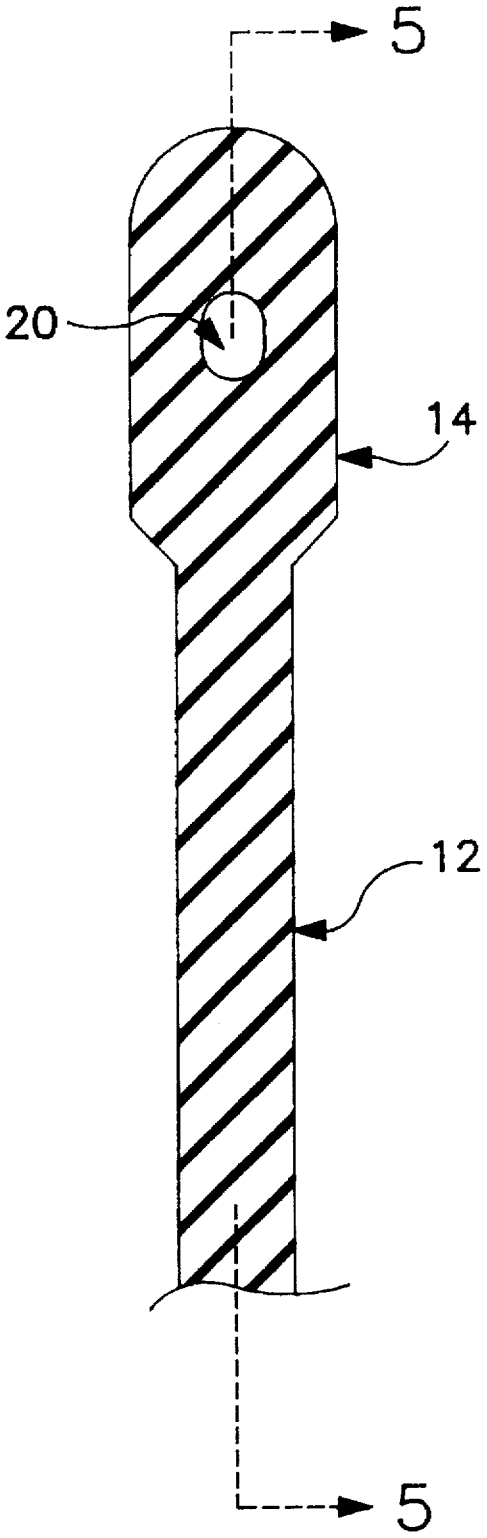
FIG. 4 is a plan view of the molded eyelet of the leash shown in FIGS. 1&2.
Figure 5:
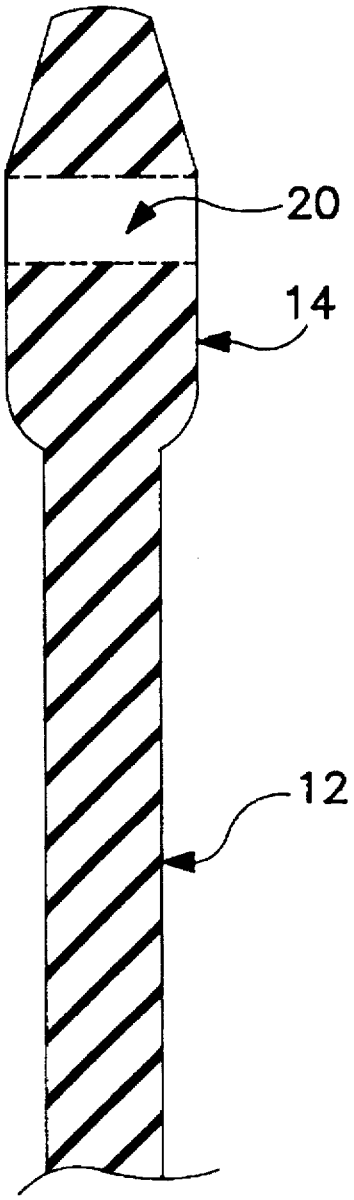
FIG. 5 is a cross-sectional view of the molded eyelet end of FIG. 4, taken along line 5—5.

As depicted in FIG. 3, the molded elastic rod 12 is a single molded article having a head 14 & 14' on each end with an opening 20 & 20' extending through each head 14 & 14'. The term "elastic" should be understood to mean flexible and resilient under tension. The rod and the attached heads with associated openings are molded from the same polymeric material in a single mold. The preferred molding technique is injection molding. However, other molding techniques may be used for producing this one piece molded article. Typically, the heads will be considerably larger in cross-sectional area than the cross-sectional area of the rod, as can be seen in FIGS. 4&5. The opening extends transversely through the head. The polymeric and/or plastic material used for molding this article may be of any type or combinations of materials known for this purpose including polyurethane, polyethylene, or the like.

The wrist or ankle connector strap may be any type known for this purpose. Typically, the strap will be formed from a strong, flexible material such as nylon, rayon or other appropriate strong, flexible materials. Similarly, the board coupler may be any device suitable for maintaining one end of the leash connected to the board.

The leash is formed by molding the rod and heads with openings as a single molded piece then attaching a wrist or ankle strap through one of the openings and inserting a portion of a board coupler through the other opening. The materials and dimensions of the leash may vary depending on the type and size of aquatic sports board it will be used with and the conditions under which the board will be operated. In operation, the leash is coupled to a board with the board coupler and attached to a rider by wrapping the wrist or ankle strap around the appropriate portion of the rider's body.

What is claimed is:

1. An aquatic board leash comprising:

a flexible solid core molded cord having a first solid core molded body at one end and a second solid core molded body at an end opposite said one end, each of the first and second solid core molded bodies integrally connected to the flexible solid core molded cord by molding the bodies and cord simultaneously, each of the first and second solid core molded bodies having a bore therethrough with first and second openings;

a first flexible connector positioned within said bore and extending outwardly from the openings in the first solid core molded body for attaching to the aquatic board;

a second flexible connector positioned within said bore and extending outwardly from the second solid core molded body for attaching to a strap, the strap adapted to be secured to a person.

2. The leash of claim 1 wherein said first solid core molded body is a first eyelet and said second solid core molded body is a second eyelet.

3. The leash of claim 1 wherein said article is formed from a plastic material.

4. The leash of claim 2 wherein said eyelets and said flexible solid core molded cord are formed of the same material.

5. The leash of claim 2 wherein the cross-sectional area of said first and second eyelets is larger than the cross-sectional area of said flexible solid core molded cord.

6. The leash of claim 1 wherein said article is injection molded.

7. An aquatic sports apparatus comprising:

an aquatic sports board; and a flexible solid core molded cord having a first solid core molded body at one end and a second solid core molded body at an end opposite said one end, each of the first and second solid core molded bodies integrally connected to the flexible solid core molded cord by molding the bodies and cord simultaneously, each of the first and second solid core molded bodies having a bore therethrough with first and second openings;

a first flexible connector positioned within said bore and extending outwardly from the openings in the first solid core molded body for attaching to the aquatic board;

a second flexible connector positioned within said bore and extending outwardly from the second solid core molded body for attaching to a strap, the strap adapted to be secured to a person.

a strap connected to second flexible connector; and a board coupler mounted to the board and connected to the first flexible connector.

8. A method of making an aquatic board leash assembly comprising:

a) molding as a single unit a flexible solid core molded core having a first solid core molded body at one end and a second solid core molded body at an end opposite said one end, each of the first and second solid core molded bodies integrally connected to the flexible solid core molded cord by molding the bodies and cord simultaneously, each of the first and second solid core molded bodies having a bore therethrough the first and second openings;

b) securing a board coupler of the aquatic board to the first solid core molded body using a first flexible connector; and c) securing a strap to the second solid core molded body using a second flexible connector.

9. The method of claim 8 wherein said flexible solid core molded cord is injection molded.

* * * * *